US012693086B2

(12) United States Patent
DiGiovanni

(10) Patent No.: US 12,693,086 B2
(45) Date of Patent: Jul. 28, 2026

(54) MANUALLY ASSISTED BELT FED MACHINE GUN DRUM ASSEMBLY

(71) Applicant: Sebastian John DiGiovanni, Cottonwood, AZ (US)

(72) Inventor: Sebastian John DiGiovanni, Cottonwood, AZ (US)

( * ) Notice: Subject to any disclaimer, the term of this patent is extended or adjusted under 35 U.S.C. 154(b) by 9 days.

(21) Appl. No.: 18/952,992

(22) Filed: Nov. 19, 2024

(65) Prior Publication Data

US 2025/0164201 A1 May 22, 2025

Related U.S. Application Data

(60) Provisional application No. 63/601,121, filed on Nov. 20, 2023.

(51) Int. Cl.
*F41A 9/79* (2006.01)
*F41A 9/34* (2006.01)

(52) U.S. Cl.
CPC . *F41A 9/79* (2013.01); *F41A 9/34* (2013.01)

(58) Field of Classification Search
CPC ..... F41A 9/61; F41A 9/79; F41A 9/80; F41A 9/81; F41A 9/29; F41A 9/34
USPC .... 89/33.14, 33.16, 33.1, 33.2, 33.25, 33.02
See application file for complete search history.

(56) References Cited

U.S. PATENT DOCUMENTS 2,303,479 A * 12/1942 Lesnick ..... F41A 9/62 42/1.03
2,354,079 A * 7/1944 Webb ..... F41A 19/01 42/1.03
3,456,553 A * 7/1969 Cermak ..... F41A 9/81 89/33.4
4,745,842 A * 5/1988 Shou-Fu ..... F41A 9/75 89/33.02
4,926,742 A * 5/1990 Ma ..... F41A 9/75 89/33.02
5,782,157 A * 7/1998 Ellington ..... F41A 9/57 89/33.16
5,905,224 A * 5/1999 Jordan ..... F41A 9/75 89/33.02
2007/0107592 A1* 5/2007 Snow ..... F41A 9/68 89/33.02

* cited by examiner

*Primary Examiner* — John Cooper
(74) *Attorney, Agent, or Firm* — Legacy Patents, LLC; Lauren Edwards Williams

(57) ABSTRACT

A cylindrical machine gun ammunition carrier drum device with hand crank and spindle, which allows operator to regulate belt-fed ammunition at a proper cyclic rate of fire and reload linked ammunition in an efficient, accelerated manner. This retract and release belt-fed ammunition method would provide proper tension and uniformity to the linked rounds, preventing the weapon from malfunctioning and improve cyclic dispersion of ammunition. This method applies to all calibers of belt-fed personal and crew-served automatic weapons. The external hand crank and internal spindle would work in unison to recover the belt if it is yanked from the cylindrical drum container prematurely. A flexible warning device ribbon connected by ammunition links would ensure all rounds are expended from within the drum when abridged from spindle to belt. Additionally, this internal warning device can be linked between belts at operator's preference.

19 Claims, 3 Drawing Sheets

MANUALLY ASSISTED BELT FED MACHINE GUN DRUM ASSEMBLY

BACKGROUND OF THE INVENTION

Technical Field

The present invention relates generally to the field of ammunition drums of existing art and more specifically relates to a manually assisted belt fed machine gun drum assembly.

Related Art

The current design of most modern ammunition drums, ammunition boxes and containers are squared off and commonly rectangular in shape, requiring a zig-zag style of belted loading. This includes belt fed ammunition pouches, which are configured the same way. Due to the design flaws in modern light and crew served automatic weapon ammunition containers, rounds and links can become misaligned or tangled as they are fed into the weapon's feed tray. This wastes critical moments when a machine gun operator engages with the enemy. There are also risks of a double feed, in which two bullets get lodged in the weapon's chamber, possibly exploding within the barrel and putting the user at great risk of injury. As a result, operators are inclined to pull the belt of linked rounds from the box and drape it across their forearm, allowing a somewhat proper feed into the weapon system. The other option is to break the belt to a smaller size and dangle it from the gun's feed tray system when mounted, to help guide the belt into said fully automatic weapon. These practices ensure the links do not get stuck within the carrier. However, pulling the belt from the ammunition container can result in the linkage becoming misaligned with the ammunition itself. Bullets might become tangled in external equipment if the operator allows them to dangle freely. This problem can also distract an assistant gunner from spotting targets of interest and covering his own sector of fire. Since machine gunner teams are roughly eighty percent of an element's firepower, it is vital to have these weapons running at an optimal cyclic rate while on the battlefield. Reloading the standard flawed drum is also time consuming, as the operator usually would prefer loading a fresh box to their weapon while on patrol, convoy operations and the like. The machine gunner might also waste valuable space in doing this with drums of ammunition less than full, only to deal with combining the links and reloading the boxes in a zig-zag pattern when there is more time.

SUMMARY OF THE INVENTION

This invention relates to all automatic belt-fed ammunition containers, carriers, drums, and the like. Consisting of a manually cranked rotary drum assembly from an internal spindle attached to/part of an external crank that creates a smoother transition between the belt fed carrier and the machine gun feed tray. The hand crank and spindle design also ensure that if the belt of ammunition were to be pulled from the drum, the rounds are retracted with minimal effort. An important feature of the present invention is the cylindrical shape combined with a center core and manual crank, which allows the user to wind the seated belt of ammunition in a rotary fashion, rather than getting links stuck together or misaligned. The crank assembly allows for reeling in the linked rounds and provides the gunner with proper tension within the spiraled belt. A warning ribbon feature with attachment links on either end will ensure every round is used and warn the operator that it is time to reload and conserve rounds as necessary, depending on placement of internal warning device. A slotted feature within the warning device ribbon accommodates single rounds of ammunition, provided for dire circumstances of survival when belt is expended.

This new spindle design with a hand crank feature will alleviate the challenges of the previously mentioned design flaws in the prior art. The machine gun drum assembly device is cheap to mass produce, costing about the same amount as current belt fed ammunition drums. It is effective in saving time in combat, will discourage the wasting and misplacement of ammunition and has minimal moving parts, avoiding breakage and loss.

FIG. is an assembled side view of the belt fed machine gun drum, according to one or more embodiments of the present disclosure.

Figure 4:
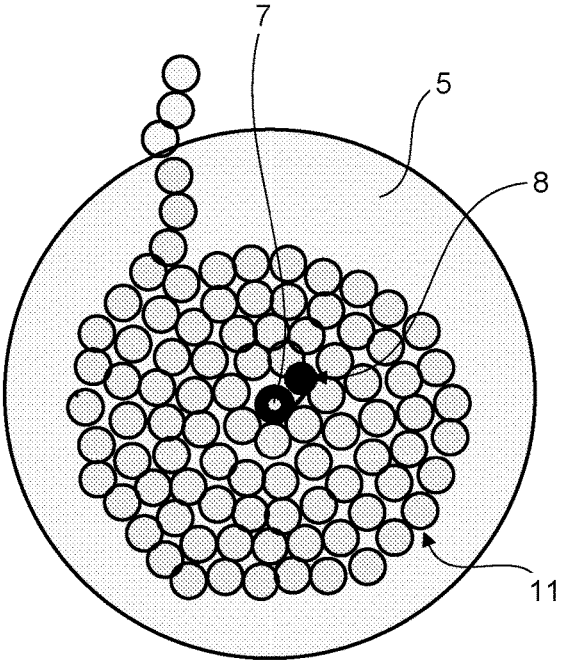

FIG. 4 is an internal view of a container of the belt fed machine gun drum, with a removable lid thereof removed to illustrate the cyclic flow of belt-fed ammunition, according to one or more embodiments of the present disclosure. The port is not shown, for clarity of illustration.

Figure 5:
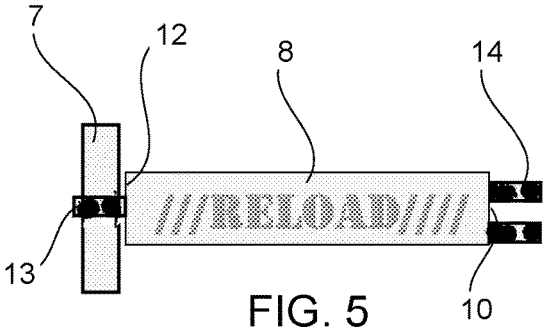

FIG. 5 is a top plan view of a warning ribbon attached to a spindle, according to one or more embodiments of the present disclosure. The warning ribbon and spindle removed from the belt fed machine gun drum for clarity.

Figure 6:
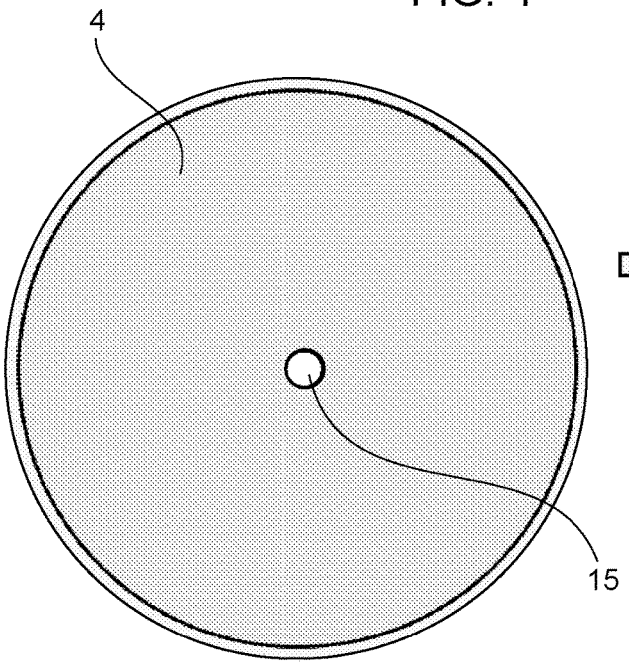

FIG. 6 is an interior view of the removable lid, according to one or more embodiments of the present disclosure.

Figure 7:
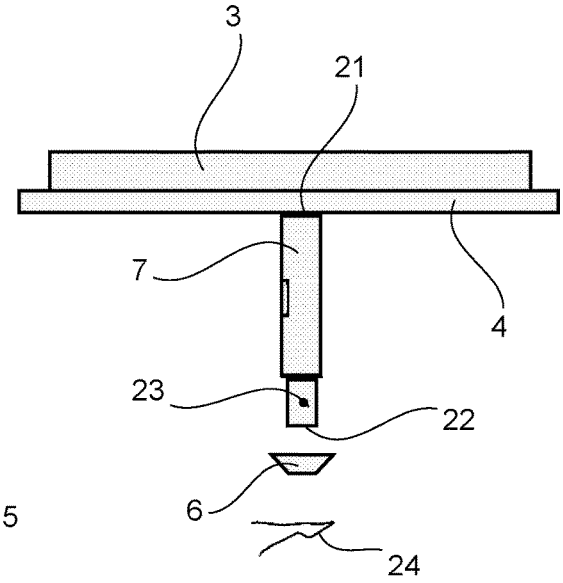

FIG. 7 is a front view of a hand crank and the spindle, according to one or more embodiments of the present disclosure. The hand crank and the spindle removed from the belt fed machine gun drum for clarity.

Figure 8A:
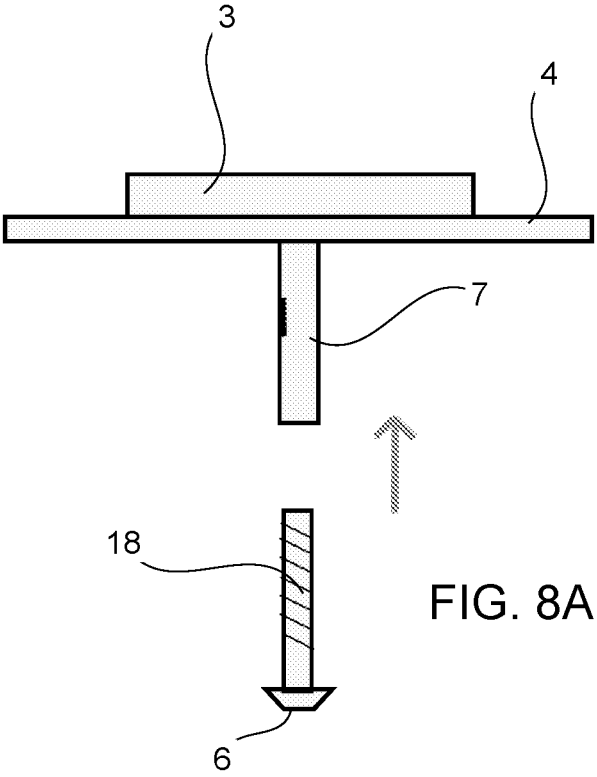

FIG. 8A is a partially exploded view showing a spiraled, interlocking core being inserted into the spindle, according to one or more embodiments of the present disclosure.

Figure 8B:
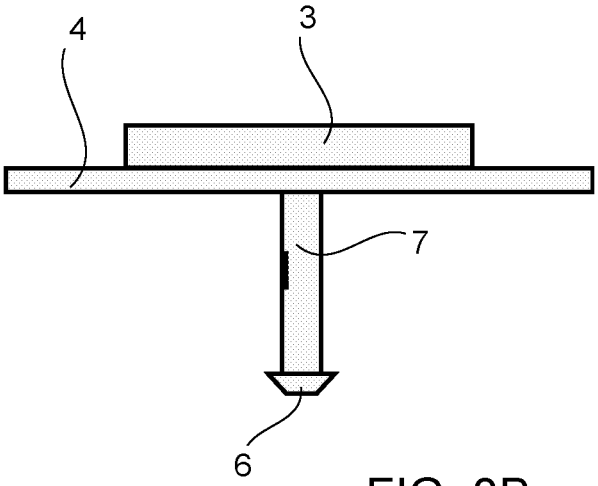

FIG. 8B is a front view of the spiraled interlocking core inserted into the spindle, according to one or more embodiments of the present disclosure.

The various embodiments of the present invention will hereinafter be described in conjunction with the appended drawings, wherein like designations denote like elements.

DETAILED DESCRIPTION OF THE INVENTION

Figure 1:
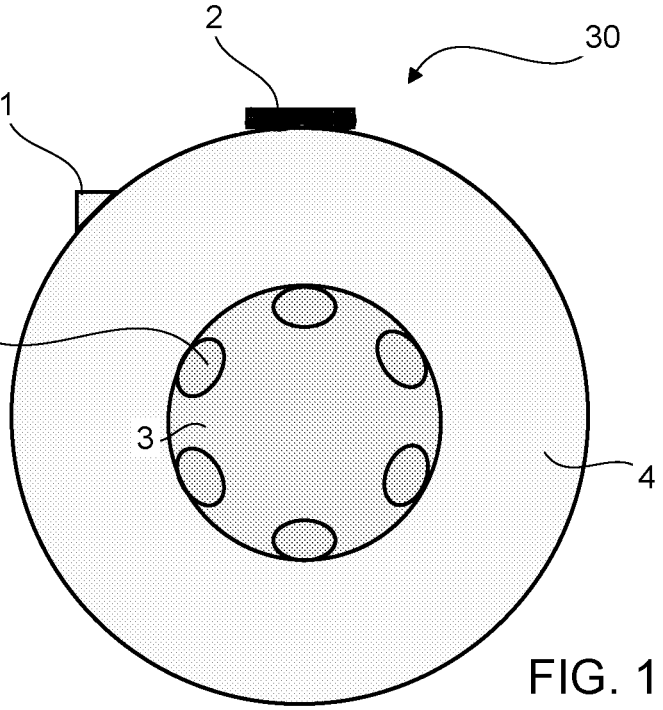
FIG. 1 is a rear view of a belt fed machine gun drum, the rear view facing a gunner as the gunner uses the belt fed machine gun drum, according to one or more embodiments of the present disclosure.
Figure 2:
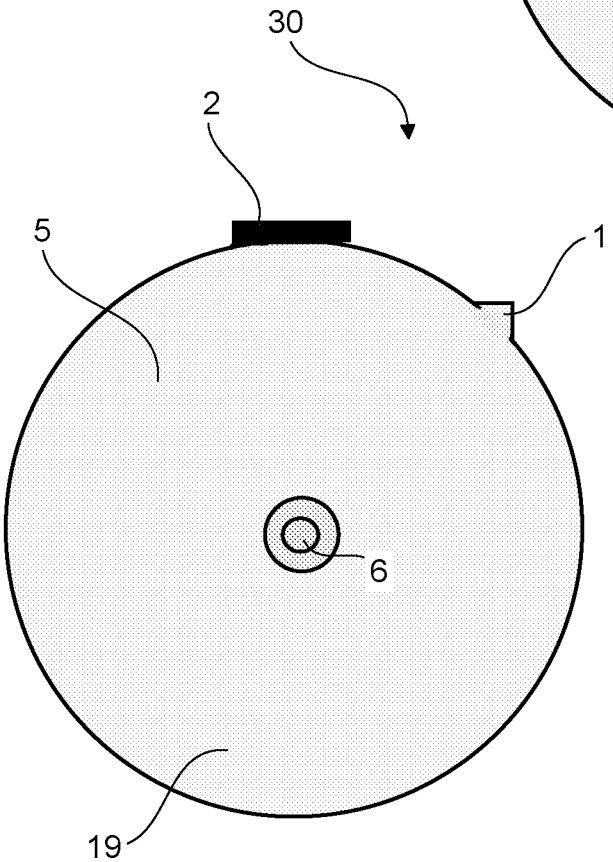
FIG. 2 is a front view of the belt fed machine gun drum, the front view facing a target at which the gunner is shooting, according to one or more embodiments of the present disclosure.

Referring now more specifically to the drawings by numerals of reference, FIG. 1 is a rear view of a belt fed machine gun drum 30, according to one or more embodiments of the present disclosure. The rear view of the belt fed machine gun drum 30 shown here is the side of the belt fed machine gun drum 30 that faces a gunner using the belt fed machine gun drum 30 (e.g., to shoot using an attached belt fed automatic weapon). FIG. 2 is a front view of the belt fed machine gun drum 30, according to one or more embodiments of the present disclosure. This side of the belt fed machine gun drum 30 faces a target (i.e., what the gunner is shooting at). An ejection port of every belt fed weapon varies greatly between calibers and configurations of the manufacturer's specifications. Ejection port 1 may be placed to provide maximum rate of fire in the cyclical position to which it is assigned, whether clockwise or counterclockwise, depending on placement of a belt fed automatic weapon's fastener 2, to attach to belt fed machine gun drum 30. The belt fed machine gun drum 30 can be used with any automatic light and crew served weapons which use belt-fed ammunition.

As shown here, the belt fed machine gun drum 30 includes a container 5, a removable lid 4, the ejection port 1, the fastener 2 to connect the belt fed machine gun drum 30 to the belt fed automatic weapon, and a hand crank 3. As shown here, the removable lid 4 is disposed over a rear 20 of the container 5. The hand crank 3, as shown here, is disposed externally, at the rear 20 of the container 5, coupled to the removable lid 4, and in communication with a spindle 7 (FIG. 4), such that that manual winding of the hand crank 3 winds an ammunition belt 11 around the spindle 7. This expedites reloading and provides proper tension and alignment. As shown here, the hand crank 3 may include a hand crank wheel with contoured grips 17.

Figure 3:
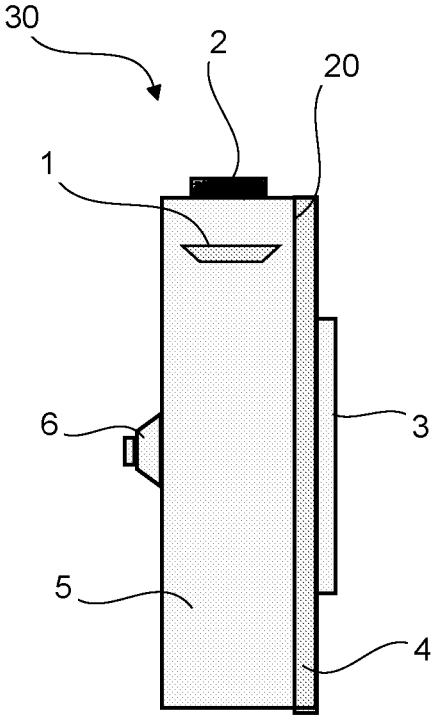

FIG. 3 is a side view of the belt fed machine gun drum 30, illustrating the ejection port 1, the fastener 2 to connect the belt fed machine gun drum 30 to the belt fed automatic weapon, the hand crank 3, a fastener 6 that connects the spindle 7 to the container 5 and the removable lid 4. As shown here, the hand crank 3 is coupled to the removable lid 4.

FIG. 4 is an internal view of the belt fed machine gun drum 30, with the removable lid 4 having been removed from the rear of the container 5 to aid in clarity of an interior of the container 5. Shown here is an ammunition belt 11 within the interior of the container 5 and having been wound around the spindle 7. Referring also to FIG. 5, which shows a top plan view of a warning ribbon 8, according to one or more embodiments of the present disclosure. The warning ribbon 8 is used to alert an operator of ammunition level status within the belt fed machine gun drum 30. In particular, the warning ribbon 8 prevents all rounds of ammunition belt 11 from being expended, due to tension from the other end affixed to the spindle 7 by way of attachment.

As shown here, the warning ribbon 8 may include a flexible material having a first end 12 opposite a second end 10. The first end 12 may be configured to attach to either of the spindle 7 or an ammunition cartridge on the ammunition belt 11, and the second end 10 may be configured to attach to a trailing end of the ammunition belt 11. Methods of attachment can be of a wide variety, to include attachment links on each side, as well as a means of permanent attachment of warning ribbon 8 to the spindle 7 as applicable. In some examples, the warning ribbon 8 may be used in between sections of ammunition belt 11. The warning ribbon 8 is not limited to attaching directly to spindle 7—in some embodiments, the warning ribbon 8 may be used independently of the spindle 7. The warning ribbon 8 is capable of separating segments of ammunition belt 11 according to operator preference. For example, the second end 10 may attach to a last ammunition cartridge at the trailing end of the ammunition belt 11, and the first end 12 may attach to another ammunition cartridge within the ammunition belt 11. In another example, the first end 12 may attach directly to the spindle 7.

In some embodiments, the warning ribbon 8 may include a first connector 13, such as a link, and a second connector 14, again, such as a link. The first link 13 may be attached to the first end 12 of the warning ribbon 8, and the second link 14 may be attached to the second end 10 of the warning ribbon 8. The first link 13 may attach to the spindle 7 or the ammunition cartridge, as discussed above; and the second link 14 may attach to the last ammunition cartridge at the trailing end of the ammunition belt 11. In some embodiments, each end 12, 10 may be attached by way of links 13, 14 from one ammunition belt to another, according to preference of operator. In some embodiments, slots within the warning ribbon 8 may accommodate single rounds of extra, emergency ammunition that are not part of the linked ammunition belt 11 to which it is attached.

In some embodiments, the warning ribbon 8 may include a flexible, durable material. For example, canvas, rubber, plastic, flexible aluminum and the like. The material chosen may be chosen based on preference of manufacturing process and desired safety specifications. In some embodiments, a length of the warning ribbon 8 can be adjusted via hook to loop, button to eyelet, clip over ribbon assembly and the like.

FIGS. 6-8B show various views of the removable lid 4, the spindle 7 and the hand crank 3, according to one or more embodiments of the present disclosure. The spindle 7 is configured to guide the ammunition belt 11 into a coiled configuration within the interior of the container 5. The removable lid 4 may include an opening 15 for a first end 21 of the spindle 7 to insert, coupling the first end 21 to the hand crank 3. Similarly, the container 5 may include an opening to receive a second end 22 of the spindle 7, and a fastener 6 to fasten the second end 22 of the spindle 7 to the container 5. As shown best in FIGS. 8A-8B, in some embodiments, the spindle 7 may include a spiraled interlocking core 18 with fastener 6. In some embodiments, a tip of the spindle 7 (at the second end 22 may include a small hole 23 to accommodate a means of additional securement, such as a cotter pin 24 or similar method, used to keep the interlocking core 18 of the spindle 17 extra secure to the tip of spindle 7.

In some embodiments, the spindle 7 may be removable. Further, in some embodiments, the spindle 7 may be configured to attach to the last ammunition cartridge of the ammunition belt 11 (e.g., via a link on the last ammunition cartridge). In some embodiments, the spindle is contoured to a size equal to a caliber of ammunition on the ammunition belt 11.

The invention claimed is:

1. A belt fed machine gun drum comprising:

a cylindrical container including an interior and a removable lid disposed over a rear of the cylindrical container, the interior configured to house an ammunition belt;

a spindle extending centrally through the interior of the cylindrical container;

a hand crank disposed externally at the rear of the cylindrical container and in communication with the spindle such that manual winding of the hand crank winds the ammunition belt around the spindle; and a warning ribbon comprising a flexible material having a first end opposite a second end, wherein the first end is configured to attach to one of the spindle and an ammunition cartridge on the ammunition belt, and wherein the second end is configured to attach to a trailing end of the ammunition belt.

2. The belt fed machine gun drum of claim 1, further comprising a first connector and a second connector, wherein the first connector is attached to the first end of the warning ribbon, and wherein the second connector is attached to the second end of the warning ribbon.

3. The belt fed machine gun drum of claim 2, wherein the first connector is a link.

4. The belt fed machine gun drum of claim 2, wherein the second connector is a link configured to attach to a last ammunition cartridge at the trailing end of the ammunition belt.

5. The belt fed machine gun drum of claim 1, wherein the spindle is contoured to a size equal to a caliber of ammunition on the ammunition belt.

6. The belt fed machine gun drum of claim 1, wherein the hand crank is coupled to the lid.

7. The belt fed machine gun drum of claim 6, wherein the lid includes an opening for receiving a first end of the spindle, coupling the first end of the spindle to the hand crank.

8. The belt fed machine gun drum of claim 1, wherein the hand crank is a hand crank wheel.

9. The belt fed machine gun drum of claim 8, wherein the hand crank wheel includes contoured grips.

10. The belt fed machine gun drum of claim 1, wherein the spindle comprises a spiraled, interlocking core.

11. The belt fed machine gun drum of claim 1, wherein a front of the cylindrical container includes an opening, wherein a second end of the spindle is configured to insert through the opening, and wherein a fastener secures the second end of the spindle to the cylindrical container.

12. The belt fed machine gun drum of claim 1, wherein the warning ribbon is constructed from a canvas material.

13. The belt fed machine gun drum of claim 1, wherein the warning ribbon is constructed from an aluminum material.

14. A belt fed machine gun drum comprising;

a cylindrical container including an interior and a removable lid disposed over a rear of the cylindrical container, the interior configured to house an ammunition belt;

a spindle including a first end opposite a second end, the first end inserted through an opening in the removable lid, the spindle extending centrally through the interior of the cylindrical container, and the second end inserted through an opening in a front of the cylindrical container;

a fastener coupling the second end of the spindle to the cylindrical container;

a hand crank coupled to the removable lid at the rear of the cylindrical container and coupled to the first end of the spindle such that manual winding of the hand crank winds the ammunition belt around the spindle; and a warning ribbon comprising a flexible material having a first end opposite a second end, wherein the first end is configured to attach to one of the spindle and an ammunition cartridge on the ammunition belt, and wherein the second end is configured to attach to a trailing end of the ammunition belt.

15. The belt fed machine gun drum of claim 14, wherein the hand crank is a hand crank wheel.

16. The belt fed machine gun drum of claim 15, wherein the hand crank wheel includes contoured grips.

17. The belt fed machine gun drum of claim 14, wherein the spindle comprises a spiraled, interlocking core.

18. A belt fed machine gun drum comprising;

a cylindrical container including an interior and a removable lid disposed over a rear of the cylindrical container, the interior configured to house an ammunition belt;

a spindle extending centrally through the interior of the cylindrical container;

a hand crank disposed externally at the rear of the cylindrical container and in communication with the spindle such that manual winding of the hand crank winds the ammunition belt around the spindle; and a warning ribbon comprising a flexible material having a first end opposite a second end, wherein the first end includes a first link configured to attach to one of the spindle and an ammunition cartridge on the ammunition belt, and wherein the second end includes a second link configured to attach to a trailing end of the ammunition belt.

19. The belt fed machine gun drum of claim 18, wherein the second link attaches to a last ammunition cartridge at the trailing end of the ammunition belt.

* * * * *